US009587919B2

(12) United States Patent
Daniau

(10) Patent No.: US 9,587,919 B2
(45) Date of Patent: Mar. 7, 2017

(54) NECKLESS CARTRIDGE

(71) Applicant: ETAT FRANCAIS REPRESENTE PAR LE DELEGUE GENERAL POUR L'ARMEMENT, Paris (FR)

(72) Inventor: Emeric Daniau, Saint-Florent sur Cher (FR)

(73) Assignee: ETAT FRANCAIS REPRESENT PAR LE DELEGUE GENERAL POUR L'ARMEMENT, Paris (FR)

( * ) Notice: Subject to any disclaimer, the term of this patent is extended or adjusted under 35 U.S.C. 154(b) by 0 days.

(21) Appl. No.: 14/891,534

(22) PCT Filed: May 13, 2014

(86) PCT No.: PCT/FR2014/000105
§ 371 (c)(1),
(2) Date: Nov. 16, 2015

(87) PCT Pub. No.: WO2014/184451
PCT Pub. Date: Nov. 20, 2014

(65) Prior Publication Data

US 2016/0091288 A1 Mar. 31, 2016

(30) Foreign Application Priority Data

May 15, 2013 (FR) ..... 13 01114

(51) Int. Cl.
*F42B 5/02* (2006.01)
*F42B 5/067* (2006.01)
*F42B 5/30* (2006.01)

(52) U.S. Cl.
CPC ..... *F42B 5/025* (2013.01); *F42B 5/067* (2013.01); *F42B 5/30* (2013.01)

(58) Field of Classification Search
CPC .. F42B 5/025; F42B 5/067; F42B 5/30–5/313
See application file for complete search history.

(56) References Cited

U.S. PATENT DOCUMENTS 2,862,446 A * 12/1958 Ringdal ..... F42B 5/067 102/430
3,485,170 A 12/1969 Scanlon
(Continued)

FOREIGN PATENT DOCUMENTS

CA 2213980 A1 * 4/1999 ..... F42B 5/025
FR 478 355 A 12/1915
(Continued)

OTHER PUBLICATIONS

McCoy, Robert L., Technical Report ARBRL-TR-02293, "MC DRAG"A Computer Program for Estimating the Drag Coefficients of Projectiles, Feb. 1981, US Army Armement Research and Development Command, pp. 23-25.*
(Continued)

*Primary Examiner* — Stephen M Johnson
*Assistant Examiner* — Joshua Semick
(74) *Attorney, Agent, or Firm* — Young & Thompson

(57) ABSTRACT

A cartridge with a composite cartridge case includes a projectile with an ogee-shaped tip and a bottom end ending in a base, a flangeless tubular case delimiting a chamber accommodating a propulsive powder, closed at a first longitudinal end by a base with a primer and at the second end opposite to the first, by the base of the projectile, a part of the flangeless tubular case fitting snugly around part of the projectile and having itself, at least in part, a frustoconical external shape, the cartridge being characterized in that: —the chamber accommodating the propulsive powder includes, at the projectile end, a reduction in its diameter over all or part of the periphery thereof down to the diameter of the base of the projectile, —the ratio between the length of the tip of the projectile and the maximum diameter thereof is greater than or equal to 2.9.

11 Claims, 1 Drawing Sheet

(56) References Cited

U.S. PATENT DOCUMENTS

| | | | | | |
|---|---|---|---|---|---|
| 5,033,386 | A * | 7/1991 | Vatsvog | F42B 5/307 | 102/430 |
| 5,151,555 | A * | 9/1992 | Vatsvog | F42B 5/307 | 86/10 |
| 5,259,288 | A * | 11/1993 | Vatsvog | F42B 5/307 | 102/430 |
| 5,708,231 | A * | 1/1998 | Koon | F42B 5/067 | 102/430 |
| 7,610,858 | B2 * | 11/2009 | Chung | F42B 5/313 | 102/466 |
| 8,443,730 | B2 * | 5/2013 | Padgett | F42B 5/313 | 102/464 |
| 8,763,535 | B2 * | 7/2014 | Padgett | F42B 5/313 | 102/466 |
| 9,032,855 | B1 * | 5/2015 | Foren | F42B 33/00 | 102/466 |
| 9,182,204 | B2 * | 11/2015 | Maljkovic | F42B 33/10 | |
| 9,200,880 | B1 * | 12/2015 | Foren | F42B 33/02 | |
| 9,395,163 | B2 * | 7/2016 | Fritz | F42B 5/025 | |
| 2006/0096488 | A1 * | 5/2006 | Cognet | F42B 5/025 | 102/444 |
| 2012/0024183 | A1 | 2/2012 | Klein | | |
| 2015/0033970 | A1 * | 2/2015 | Maljkovic | F42B 5/307 | 102/467 |
| 2015/0241183 | A1 * | 8/2015 | Padgett | F42B 5/025 | 102/466 |

FOREIGN PATENT DOCUMENTS

| | | | | |
|---|---|---|---|---|
| FR | 2 831 255 | A1 | 4/2003 | |
| WO | WO 8300213 | A1 * | 1/1983 | F42B 5/067 |
| WO | WO 9513516 | A1 * | 5/1995 | F42B 5/067 |
| WO | WO 0034732 | A1 * | 6/2000 | F42B 5/067 |
| WO | WO 0133155 | A2 * | 5/2001 | F42B 5/025 |
| WO | 03/036221 | A1 | 5/2003 | |

OTHER PUBLICATIONS

Heigel H J: "Wiederladen .444 Marlin Dicke Pille", DWJ Deutsches Waffen Journal, DWJ Verlags, Blaufelden, DE, vol. 44, No. 10, Oct. 1, 2008, pp. 104-105, XP001515570, ISSN: 0341-8936 the whole document.

International Search Report, Sep. 25, 2014, from corresponding PCT Application.

* cited by examiner a

NECKLESS CARTRIDGE

BACKGROUND OF THE INVENTION

Field of the Invention

The invention relates to the field of cartridged ammunitions and, more particularly, to the field of mounting or blocking projectiles in cartridge cases.

Description of the Related Art

The metal case cartridge with a bottle shape and a center fire is universally used for all light weaponry. It has remained essentially unchanged since its invention at the end of the XIXth century.

It consists, as shown in FIG. 1, in a tubular case 1 made of brass, or even steel, containing a propellant powder charge 2 and receiving, at a first longitudinal end 3, a head 4 with a primer 5, and having, at its other longitudinal end 6, a diameter reduction forming an external shoulder 7 and then a neck 8 and a projectile 9, with an ogival-shaped nose $\mathbf{9}_1$ and a base $\mathbf{9}_2$ having a first portion of a constant diameter, followed by a second portion whose diameter decreases up to its head $\mathbf{9}_3$, said projectile being forcibly pressed into or even crimped in the neck 8 at this first portion of the base. The shoulder is intended to cooperate with a part of the weapon of a complementary shape allowing to reproducibly position the cartridge longitudinally.

This case fulfills several roles:

- It ensures the mechanical integrity of the shot during the handling and loading phases, which can be brutal in the case of automatic reloading weapons,
- It ensures, by its neck, a repeatable positioning of the projectile, partially guaranteeing the accuracy of the system, as well as a regular pull-out force of the projectile for ensuring optimal and repeatable internal ballistics,
- On the one hand, when firing the shot and under the action of the pressure forces, the case body elastically deforms and ensures the (rear) sealing of the chamber and prevents any burnt gas blowback towards the gunner and, on the other hand, when the pressure drops, the case returns to its original dimensions allowing its extraction at the end of the cycle,
- By its design, the head should not deteriorate in order to avoid any gas leakage around the primer, or worse, an ejection thereof.

It can be noted that the neck has itself a central role, since it ensures:

- the interface between the case and the projectile,
- a good concentricity of the shot,
- a pull-out force as constant as possible over the whole temperature range, and it is constrained both on its external diameter, determined by the weapon chamber, and on its internal diameter, determined by the diameter of the projectile.

In addition, due to the geometry of a bottle-shaped case, such as that of FIG. 1, which is implemented in most modern military ammunitions for long weapons, the connection between the conical shoulder 7 and the cylindrical neck 8 is a stress concentration area likely to produce a separation of the two, the neck 8 remaining "stuck" in the chamber while the remainder of the case is extracted, preventing the weapon from being reloaded.

Furthermore, a case accounts for about 50% of the mass of the shot, and 50% of its price, this part increasing constantly due to the rising price of copper, which is the major component of brass.

Significant efforts have been undertaken to try to reduce, or even eliminate, this element and thus reduce by 50% the mass of ammunitions.

A first solution consisted in working on ammunitions whose propellant charge itself ensured the mechanical integrity of the shot, with the sealing of the chamber being ensured by the mechanical design thereof. These efforts culminated in the "near acceptance" of the G11K2 rifle by the German army during the 80s, and of its caseless 4.7×33 mm ammunition.

However, this type of cartridge has a number of disadvantages, such as:

- the aging of the sealing ring of the chamber,
- an auto-ignition risk in case combustion residues are present,
- a risk of contamination of the weapon by bits of powder in case of a mis-insertion of the ammunition in the chamber.

A second solution was the replacement of the brass or steel case by a case made of a light alloy or composite materials, allowing to reduce by ⅔ the mass of the case, namely an overall mass saving of the cartridge of about 33%.

The use of metals lighter than brass or steel has been suggested. However, there is no aluminum alloy having both the required toughness for holding the primer and a yield strength avoiding the formation of cracks on the body of the case. Indeed, either the head resists and cracks appear on the body, or the body resists but leaks appear at the head. Moreover, in case the case breaks, aluminothermy phenomena happen, with the case partially consuming itself generating hot spots that can cause the destruction of the weapon. Therefore, the applications of light alloy cases are limited to some handgun ammunitions involving a low chamber pressure.

In parallel, the use of technical polymers, especially the technical polymers referred to as "high temperature" technical polymers, has also been suggested. In this respect the patent application U.S. Pat. No. 2,862,446 is known, which describes, as shown in FIG. 2, a cartridge comprising a polymer tubular case 11 containing a propellant powder charge 12 and receiving, at a first longitudinal end 13, a metal head 14 with a primer 15, and having, at the other longitudinal end 16, a diameter reduction forming a shoulder 17 and then a neck 18 molded on a projectile 19.

However, the use of such cartridges is facing many difficulties, namely:

- When making cases by injection, the neck, whose thickness is generally lower than that of the rest of the case, can have irregularities caused by a mis-filling of the mold, which is a source of waste.
- The lower mechanical strength of the polymer compared to that of brass implies using thicker walls, which reduces the loading volume of the case by the order of about 15%,
- This reduction of the loading volume of the case implies using, with an identical projectile and for identical performance, a compressed charge and, consequently, increasing the maximum chamber pressure,
- When inserting the projectile, the neck inflates, shortens and can crack.
- When firing, it can happen from time to time, between once in a hundred times and once in a thousand times, that the neck separates from the case and remains welded to the chamber. While this incident rate is acceptable for a "civilian" application, it is incompatible with a military application.

Also known is patent WO03036221 which describes a cartridge comprising, on the one hand, a projectile with an ogival-shaped nose and a base ending with a head and, on the other hand, a polymer neckless tubular case delimiting a propellant powder receiving chamber closed at a first longitudinal end by a head with a primer and closed at the second end, opposite to the first end, by the base of the projectile, with a portion of the neckless tubular case enclosing a portion of the projectile and having itself, at least in part, a frustoconical external shape.

However, such a projectile comprises a combustion chamber of the same diameter as that of the projectile which considerably limits the range of the projectile and does not allow, for example, to replace the "bottleneck" or "bottle"-type metal cartridges with a 5.56- or 7.62-caliber metal case, such as that shown for example in FIG. 1, by this type of cartridge, but only to use them for exercises on targets at a short distance.

BRIEF SUMMARY OF THE INVENTION

The aim of the invention is to solve the above-mentioned disadvantages by providing a cartridge with a low weight and reliable when in use, thus compatible with a use in the military field and, preferably, which can be substituted for the "bottleneck" or "bottle"-type metal cartridges with a 5.56- or 7.62-caliber metal case.

The provided solution is a cartridge, especially with a composite case, comprising, on the one hand, a projectile with an ogival-shaped nose and a base ending with a head and, on the other hand, a neckless tubular case defining a propellant powder receiving chamber closed at a first longitudinal end by a head with a primer and closed at the second longitudinal end, opposite to the first one by the head of the projectile, with a portion of the neckless tubular case enclosing a portion of the projectile and having itself, at least in part, a frustoconical external shape, the cartridge being characterized in that:

- the propellant powder receiving chamber has, on the projectile side, a reduction of its diameter over all or part of its periphery up to that of the head of the projectile,
- the ratio between the length of the nose of the projectile (29, 49) and its maximum diameter is greater than or equal to 2.9.

Such a cartridge has a nose longer than that of prior art cartridges, thus providing a reduced drag in supersonic flight phase. The projectile base may comprise, for example, an end which is flat, hollow or has a curtailed head.

Such a cartridge is especially intended to be substituted for the "bottleneck" or "bottle"-type traditional ammunitions with a metal case, with the external shape of the case then being, except for the neck, the same as that of a metal case, and the frustoconical external shape of the portion enclosing a portion of the projectile acting as a shoulder on the weapon.

Furthermore, reducing the diameter of the combustion chamber to that of the head of the projectile corresponds to a gradual reduction in the internal diameter of the case over all or part of its perimeter, thereby forming a convergent which allows to increase the speed of the combustion gases, and therefore to increase the exit speed of the projectile.

Thus, despite the decrease of the volume of the propellant powder receiving chamber due to the increase of the length of the projectile in order to obtain a ratio greater than 2.9, the shape of the latter and the presence of the convergent allow to compensate for the smaller amount of propellant powder contained in the cartridge.

According to a particular feature, the cartridge comprises a tubular case made of polymer while the head of the cartridge, associated to the primer, is for example made of aluminum, thereby forming a composite case.

In addition, with respect to the existing cartridges, such a cartridge is much lighter and allows the use of a projectile having a longer nose, typically having one more caliber, allowing to increase the effective range with respect to prior art cartridges. For example, with respect to an ammunition of an M80-type 7.62×51 mm caliber, a cartridge according to the invention, using a lead-cored jacketed projectile with the same mass as the M80 projectile but with a higher length, allows to increase the effective range by about 200 m.

The ogival-shaped nose can, for example, be of a tangent type, secant-type or hybrid-type, that is to say, combining these two profiles, or with a minimal drag, such as, for example, of the LD or LV Haack type.

According to a particular feature, the ratio between the length of the nose of the projectile and its maximum diameter is between 2.9 and 4.1 and, preferably, about 3.5.

According to another feature, the diameter reduction of the combustion chamber to that of the head of the projectile corresponds to a gradual reduction of the internal diameter of the case, the latter having, at this level, a frustoconical shape with a half angle $\alpha$ between 20 and 40 degrees.

According to another particular feature, the projectile has a mainly cylindrical base and the case comprises, at its second longitudinal end and in the head-projectile direction, a first portion having a gradual reduction of its internal diameter over all or part of its perimeter, for example by forming ribs, a second portion of a constant thickness, the internal face of which is, at least partially, and preferably completely in contact with the projectile and then a terminal portion constituted by the external shoulder, the internal face of which is in contact with the projectile.

According to an additional feature, the first portion comprises a gradual reduction of its internal diameter up to the head of the projectile and having a frustoconical shape and the length of the second portion is at least equal to a third of the length of the terminal portion.

According to another particular feature for forming a nozzle at the exit of the combustion chamber, on the projectile side, the projectile has a base having, at least on a part, a gradual decrease of its diameter up to its head and, preferably, the case comprises, at its second longitudinal end and in the head-projectile direction, a first portion having a gradual decrease of its internal diameter up to the head of the projectile over all or part of its perimeter, a second portion of an external diameter equal to that of the first portion and of an increasing internal diameter conforming to a part of the base of the projectile and then a terminal portion constituted by the shoulder, the internal face of which is in contact with the projectile.

According to one feature, the length of the second portion is at least equal to a third of the length of the third portion.

According to an additional feature, a cartridge according to the invention has a caliber of 5.56 mm, or 7.62 mm or 12.7 mm and, preferably, its maximum length is of 57.4 mm (2.26 in), 71.9 mm (2.83 in), 140.8 mm (5.545 in), respectively.

BRIEF DESCRIPTION OF THE DRAWINGS

Other advantages and features will become apparent from the description of several embodiments of the invention, with reference to the appended figures in which.

DETAILED DESCRIPTION OF THE PREFERRED EMBODIMENTS

Figure 1:
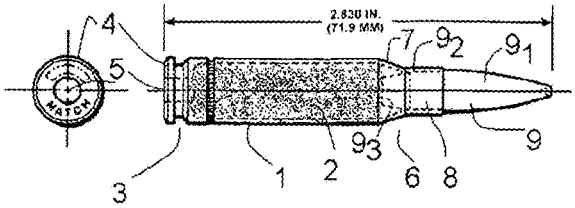
FIG. 1 shows a metal case cartridge with a bottle shape and a center fire.
Figure 2:
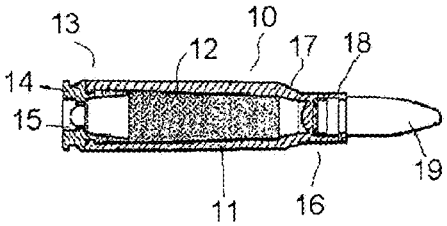
FIG. 2 shows a cartridge comprising a polymer tubular case.
Figure 3A:
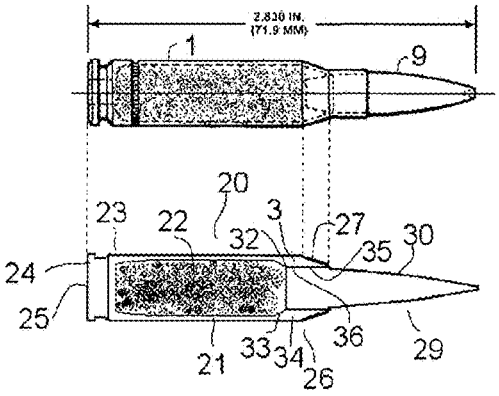
FIG. 3*a* shows a diagram of a longitudinal section of a cartridge according to a first embodiment of the invention with respect to a cartridge according to FIG. 1.
Figure 3B:
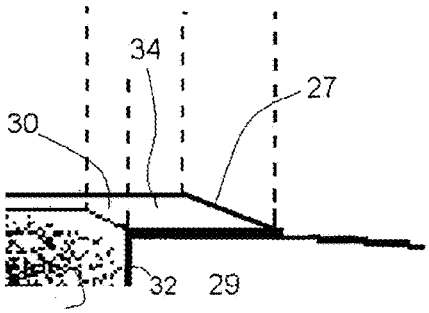
FIG. 3*b* shows an enlarged portion of FIG. 3*a*, in this case of the portion of the end of the case located on the projectile side.

FIG. 3*a* shows a diagram of a longitudinal section of a cartridge according to a first embodiment of the invention with respect to a cartridge according to FIG. 1.

This cartridge 20, of a 7.62 mm caliber, comprises, on the one hand, a projectile 29 with an ogival-shaped nose 30, and a cylindrical base 31 ending with a head 32 and, on the other hand, a bottle-shaped tubular case 21 made of polymer and containing a propellant powder charge 22 and receiving, at a first longitudinal end 23, a head 24 with a primer 25, and comprising, at its second longitudinal end 26, and in the head 24-projectile 29 direction:

- a first portion 33 with a constant external diameter D1 and a gradual reduction of its internal diameter and then
- a second portion 34, with an external diameter D1 and a constant thickness, the inner face of which is completely in contact with the projectile and then
- a terminal portion constituted by a gradual reduction of its external diameter forming an external shoulder 27, the inner face of which is in contact with the projectile 29. The shoulder 27 is intended to cooperate with a part of a weapon adapted to fire this type of cartridge, with this part of the weapon being of a complementary shape and allowing to reproducibly position the cartridge longitudinally.

Thus, the inner face 35 of the shoulder 27 is in contact with the projectile 29 and constitutes the terminal portion of the case 21 on the side of the projectile 29.

The case is made of polymer and fixing the projectile to the case is obtained by overmolding. The head 24 is made of a light metal material, in this case aluminum. It is attached to the rear of the case by bonding or by threading/tapping.

In this embodiment, the ratio between the length of the nose of the projectile and its maximum diameter is equal to 3.5. In addition, the ratio of the length of the second portion to the length of the third portion is about 0.6.

The case body is characterized by an absence of a neck, rendered useless by the overmolding process. The connection between the case and the projectile is now at said second and third portions 31 and 27, thereby ensuring an excellent mechanical strength of the assembly, ensuring the concentricity thereof and using the space freed by removal of the neck to lengthen the nose of the projectile and thus reduce its drag.

Said drag reduction is essential since it allows, while ensuring the required trajectory concordance with existing loads, either to use a lighter projectile fired at the same initial speed, or a projectile with the same mass fired with a reduced initial speed.

In both cases, this allows to reduce the initial kinetic energy which concurs with the required reduction of the propellant charge caused by the use of composite cases and this without reducing the final performance at medium or long distance.

Such a composite ammunition with an added-on light alloy head, assuming the external profile of the 7.62×51 mm ammunition, having a case with a capacity of 2.85 $cm^3$, against 3.5 $cm^3$ for the brass-cased 7.62×51 mm ammunition, and equipped with a "lead-free" projectile with a mass of 8.4 grams with a reduced drag, propelled at an initial speed of 830 m/s in a 61 cm long tube, essentially provides the same performance at 600 m as the M80-type loading with an ordinary bullet, but with a recoil reduced by an order of about 20%, related to the reduction of the propellant charge and of the projectile mass, and a shot mass reduced by almost 40% thanks to the gains on the case, on the projectile and on the powder mass.

For a machine-gunner using a weapon in that caliber, and having an allocation of 800 cartridges, this represents a gain of almost 8 kg, with the reduction of the recoil of the weapon allowing a significant gain in accuracy, and the reduction of the powder mass allows to limit the warm-up of the weapon at the same practical rate of fire.

Removing the neck releases a side "vent" of 0.45 mm on either side of the projectile, which must pass an additional "leap" of 8.16 mm before coming into contact with the forcing cone and taking up the rifling. In order to prevent this leap from causing a loss of accuracy, the foot of the ogive has a tangential profile which allows it to "self-center" upon arrival on the forcing cone.

The use of a projectile both longer than the original one and made of a material less dense than lead implies an important stress on its gyroscopic stability. In order to maintain a value consistent with military use, the projectile has a recessed base, such as encountered on the so-called "Minié" bullets or on the "Very High Speed"-type projectiles marketed by the company SFM in the early 80s.

This recess remains of a small diameter to prevent any expansion or fragmentation risk of this hollow base, even after a 180° tilt on its axis, which may occur in the event of an impact in a semi-liquid medium.

If the given example focuses on the comparison with the 7.62×51 mm cartridge, it is of course applicable to any conventional "bottle"-type ammunition for a long weapon, with equivalent gains such as, for example, a reduction of the mass of the shot and a reduction of the recoil at iso-performance.

Figure 4A:
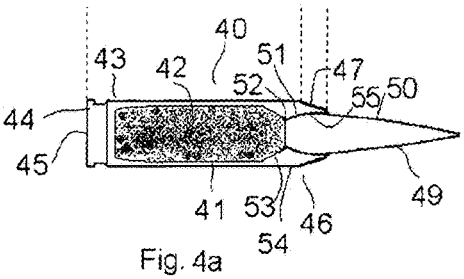
FIG. 4*a* shows a diagram of a longitudinal section of a cartridge according to a second embodiment of the invention.
Figure 4B:
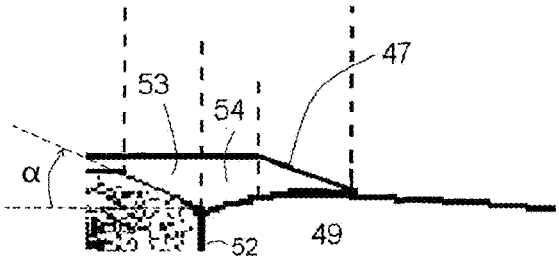
FIG. 4*b* shows an enlarged portion of FIG. 4*a*, in this case of the portion of the end of the case located on the projectile side.

FIG. 4 shows a cartridge 40 according to a first embodiment of the invention.

This cartridge 50 comprises, on the one hand, a projectile 49 with an ogival-shaped nose 40 and a base 51 having a gradual reduction of its diameter up to its head 52 and, on the other hand, a bottle-shaped tubular case 41 made of polymer, containing a propellant powder charge 42, and receiving at a first longitudinal end 43 a head 44 with a primer 45, and comprising, at its second longitudinal end 46, and in the head 44-projectile 49 direction, a first portion with a constant external diameter D1 and a gradual reduction of its internal diameter, a second portion 54 of an external diameter D1 and an increasing internal diameter conforming to a corresponding portion of the projectile base and then a terminal portion constituted by a gradual reduction of its external diameter forming an external shoulder 47, the inner face of which is in contact with the projectile.

The gradual reduction of the internal diameter of the case is such that it has, at this level, a frustoconical internal shape, and preferably I.

Thus, the inner face 55 of the shoulder 47 is in contact with the projectile 49 and constitutes the terminal portion of the case 41 on the side of the projectile 49.

The case is made of polymer and fixing the projectile to the case is obtained by overmolding. The head is made of a light metal material, in this case aluminum. It is attached to the rear of the case according to the embodiment shown in U.S. Pat. No. 2,862,446.

In this embodiment, the ratio between the length of the nose of the projectile and its maximum diameter is equal to 3. This curtailed head projectile profile type allows a significant drag reduction, mainly in the subsonic range, and therefore at long distances, with a slight decrease in performance at short and medium distance, due to the instabilities at the exit of the mouth.

Of course, without departing from the scope of the invention, a nozzle could be made even with a projectile according to FIG. 3*a* by making a tubular case comprising, on the projectile side, a gradual reduction of its internal diameter up to a diameter smaller than that of the head of the projectile and then an increase of this internal diameter up to that of the head of the projectile.

The invention claimed is:

1. A cartridge comprising:

a projectile with an ogival-shaped nose and a base ending with a head; and a polymer neckless tubular case defining a propellant powder receiving chamber closed at a first longitudinal end by a head with a primer and at a second longitudinal end that is opposite to the first longitudinal end by the head of the projectile, with a portion of the neckless tubular case enclosing a portion of the projectile and the portion of the neckless tubular case enclosing a portion of the projectile having, at least in part, a frustoconical external shape, wherein the propellant powder receiving chamber has, on the projectile side, a reduction of the diameter of the propellant powder receiving chamber over at least part of the periphery of the propellant powder receiving chamber up to the diameter of the head of the projectile, the ratio between the length of the nose of the projectile and the maximum diameter of the projectile is greater than or equal to 2.9, the projectile has a base having, at least in part, a gradual reduction of the diameter of the base up to the head of the base, and the case has, at the second longitudinal end of the case and in the head-projectile direction, a first portion having, over at least part of the perimeter of the first portion, a gradual reduction of the internal diameter of the first portion up to the head of the projectile, a second portion of an external diameter equal to the diameter of the first portion and of an increasing internal diameter conforming to a portion of the base of the projectile and then a terminal portion constituted by a shoulder, an inner face of the shoulder being in contact with the projectile.

2. The cartridge according to claim 1, wherein the ratio between the length of the nose of the projectile and the diameter of the projectile is between 2.9 and 4.1.

3. The cartridge according to claim 1, wherein the reduction of the diameter of the combustion chamber up to the diameter of the head of the projectile corresponds to a gradual reduction of the internal diameter of the case, the case having, at this level, a frustoconical shape with a half-angle $\alpha$ between 20 and 40 degrees.

4. The cartridge according to claim 1, wherein the length of the second portion is at least equal to a third of the length of the terminal portion.

5. The cartridge according to claim 1, wherein the caliber of the cartridge is 5.56 mm.

6. The cartridge according to claim 5, wherein the caliber of the cartridge is 5.56 mm and the maximum length of the cartridge is 57.4 mm (2.26 in).

7. The cartridge according to claim 1, wherein the ratio between the length of the nose of the projectile and the diameter of the projectile is about 3.5.

8. The cartridge according to claim 1, wherein the caliber of the cartridge is 7.62 mm.

9. The cartridge according to claim 1, wherein the caliber of the cartridge is 12.7 mm.

10. The cartridge according to claim 8, wherein the caliber of the cartridge is 7.62 mm and the maximum length of the cartridge is 71.9 mm (2.83 in).

11. The cartridge according to claim 9, wherein the caliber of the cartridge is 12.7 mm and the maximum length of the cartridge is 140.8 mm (5.545 in).

* * * * *